US012637799B2

(12) United States Patent
Kim et al.

(10) Patent No.: US 12,637,799 B2
(45) Date of Patent: May 26, 2026

(54) LAUNDRY TREATING APPARATUS

(71) Applicant: LG ELECTRONICS INC., Seoul (KR)

(72) Inventors: Younghun Kim, Seoul (KR); Sungwoon Jung, Seoul (KR); Kunwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 85 days.

(21) Appl. No.: 18/708,514

(22) PCT Filed: Dec. 8, 2022

(86) PCT No.: PCT/KR2022/019916
§ 371 (c)(1),
(2) Date: May 8, 2024

(87) PCT Pub. No.: WO2024/101516
PCT Pub. Date: May 16, 2024

(65) Prior Publication Data

US 2025/0257514 A1 Aug. 14, 2025

(30) Foreign Application Priority Data

Nov. 11, 2022 (KR) ..... 10-2022-0150763

(51) Int. Cl.
*D06F 39/02* (2006.01)
*D06F 37/12* (2006.01)
*D06F 39/08* (2006.01)

(52) U.S. Cl.
CPC ..... *D06F 39/02* (2013.01); *D06F 37/12* (2013.01); *D06F 39/088* (2013.01)

(58) Field of Classification Search
CPC ..... D06F 39/022
See application file for complete search history.

(56) References Cited

U.S. PATENT DOCUMENTS

2019/0345661 A1 11/2019 Ko et al.

FOREIGN PATENT DOCUMENTS

| | | | |
|---|---|---|---|
| CN | 206736571 | U | 12/2017 |
| CN | 114108261 | A | 3/2022 |
| JP | 62-286495 | A | 12/1987 |
| JP | 2021-10647 | A | 2/2021 |
| JP | 2022-522691 | A | 4/2022 |
| JP | 2022-127188 | A | 8/2022 |

(Continued)

*Primary Examiner* — Jason Y Ko
(74) *Attorney, Agent, or Firm* — Birch, Stewart, Kolasch & Birch, LLP

(57) ABSTRACT

A laundry treating apparatus includes a cabinet having a cover and a laundry inlet extending through the cover, a tub disposed inside the cabinet to provide a space for storing water, a drum that is rotatably disposed inside the tub and stores laundry introduced into the laundry inlet therein, a mounting portion including a hub fixed to the cover, and a first mounting groove and a second mounting groove facing each other along a width direction of the cover with the hub interposed therebetween, a first detergent box that stores detergent supplied to the tub and is slidable toward the hub from an edge of the first mounting groove along the width direction of the cover, and a second detergent box that stores the detergent supplied to the tub and is slidable toward the hub from an edge of the second mounting groove along the width direction of the cover.

20 Claims, 14 Drawing Sheets

(56) References Cited

FOREIGN PATENT DOCUMENTS

| | | | |
|---|---|---|---|
| JP | 2022-169163 | A | 11/2022 |
| KR | 10-2010-0066172 | A | 6/2010 |
| KR | 10-2018-0080013 | A | 7/2018 |

(a)

(b)

LAUNDRY TREATING APPARATUS

CROSS REFERENCE TO RELATED APPLICATIONS

This application is the National Phase of PCT International Application No. PCT/KR2022/019916, filed on Dec. 8, 2022, which claims priority under 35 U.S.C. 119(a) to Patent Application No. 10-2022-0150763, filed in the Republic of Korea on Nov. 11, 2022, all of which are hereby expressly incorporated by reference into the present application.

TECHNICAL FIELD

The present disclosure relates to a laundry treating apparatus.

BACKGROUND

A laundry treating apparatus that removes dirt from an object-to-be-washed (laundry or the like) using water includes a tub in which water is stored, a drum rotatably disposed inside the tub and storing the laundry therein, a water supply that supplies water to the tub, and a drainage that drains water stored in the tub.

For easy removal of the dirt, among existing laundry treating apparatuses, there was one that is equipped with a detergent supply apparatus that supplies detergent to the tub. Among the existing detergent supply apparatuses, there was one that includes a drawer extendable from a cabinet of the laundry treating apparatus, and a detergent passage defined in the drawer to guide the detergent to the tub.

In the existing detergent supply apparatus described above, the water supply supplies water to the detergent passage. Therefore, when the water supply is operated, the detergent introduced into the detergent passage was supplied to the tub along with water (Publication number 10-2020-0007549). However, the detergent supply apparatus described above had a possibility of injecting more detergent than necessary, and there was an inconvenience in that a user has to inject the detergent into the detergent passage every time washing is necessary.

To solve the above-mentioned shortcomings, among the existing detergent supply apparatuses, there was one that automatically supplies the detergent to the tub during the washing.

The existing automatic detergent supply apparatus includes a detergent box (also known as a cartridge) that is detachable from the laundry treating apparatus and provides a space for storing the detergent, and a transferrer that transfers the detergent to the tub when the cartridge is mounted in the laundry treating apparatus.

The automatic detergent supply apparatus described above may store a relatively great amount of detergent in the cartridge, and a controller may adjust an operating time point and an operating time duration of the transferrer, so that not only an appropriate amount of detergent may be supplied to the tub, but also an inconvenience of the user supplying the detergent to the tub when the washing is necessary may be solved.

It was general that the cartridge disposed in the existing automatic detergent supply apparatus is extended from the cabinet of the laundry treating apparatus. That is, conventionally, the cartridge had a structure of being extended from a casing fixed to the cabinet to be located under the tub, a casing fixed to the cabinet to be located on the tub, or a casing fixed to a top surface of the cabinet and exposed to the outside of the laundry treating apparatus (Publication number 10-2018-0096008, Publication number 10-2020-0120202).

Because great vibrations may be intermittently transmitted to the cabinet when the laundry treating apparatus operates, the casings fixed inside the cabinet to be located under the tub and on the tub have a low risk of the cartridge being extended from the cabinet.

However, because the cartridge disposed in the casing exposed to the outside of the cabinet is highly likely to be separated from the casing when the laundry treating apparatus vibrates, the existing automatic detergent supply apparatuses had a structure in which the casing surrounds all surfaces excluding one surface of the cartridge.

That is, the existing casing had a structure that surrounds a top surface, both side surfaces, and a rear surface of the cartridge, excluding a front surface where an outlet of the cartridge is disposed. This is to minimize the risk of the cartridge being separated from the case by the vibration.

However, the structure in which only one surface of the cartridge is exposed to the outside of the casing had inconvenience of requiring the user to extend the cartridge from the casing to supply the detergent to the cartridge or check a remaining amount of detergent.

In addition, the automatic detergent supply apparatus had a structural limitation that it is difficult to increase a volume of the cartridge when applied to a top-loading laundry treating apparatus.

The top-loading laundry treating apparatus is a laundry treating apparatus that puts the laundry into the drum via a laundry inlet defined in the top surface of the cabinet. Because the laundry inlet is located at a center of a space provided by the top surface of the cabinet, the cartridge had to be installed in a space other than the space where the laundry inlet is located.

That is, the casing had to be installed in a space located in front of the laundry inlet or a space located at the rear of the laundry inlet among spaces provided by the top surface of the cabinet, and the cartridge was inserted into the casing by moving rearwards from the space in front of the laundry inlet (Publication number 10-2018-0080013).

However, the rear space of the cabinet top surface has a vertical length (a length of the cabinet in a depth direction, a length of the rear space parallel to a cartridge insertion direction) smaller than a horizontal length (a length of the cabinet in a width direction), and the transferrer (a pump or the like) that transfers the detergent of the cartridge to the tub must be installed inside the casing, so that it was difficult for the existing automatic detergent supply apparatus to design the cartridge to have a great storage capacity.

SUMMARY

Technical Problem

The present disclosure is to provide a laundry treating apparatus equipped with a detergent supply that is mounted in a state of being exposed to the outside of a cabinet.

In addition, the present disclosure is to provide a laundry treating apparatus equipped with a detergent supply that may not only store a great amount of detergent, but also minimize a risk of separation from a cabinet by vibration.

In addition, the present disclosure is to provide a laundry treating apparatus that may introduce detergent into a detergent supply mounted on a cabinet.

In addition, the present disclosure is to provide a laundry treating apparatus that may check a remaining amount of detergent without removing a detergent supply from a cabinet.

Technical Solutions

Provided is a laundry treating apparatus including a cabinet having a cover forming a top surface and a laundry inlet extending through the cover, a tub disposed inside the cabinet to provide a space for storing water, a drum that is rotatably disposed inside the tub and stores laundry introduced into the laundry inlet therein, a mounting portion including a hub fixed to the cover, and a first mounting groove and a second mounting groove provided to face each other along a width direction of the cover with the hub interposed therebetween, a first detergent box that stores detergent to be supplied to the tub and is slidable toward the hub from an edge of the first mounting groove along the width direction of the cover, and a second detergent box that stores the detergent to be supplied to the tub and is slidable toward the hub from an edge of the second mounting groove along the width direction of the cover.

The mounting portion may include a first fastening pipe protruding from the hub along the width direction of the cover and connecting the tub with the first detergent box, and a second fastening pipe protruding from the hub along the width direction of the cover and connecting the tub with the second detergent box.

The first detergent box may include a first storage body where the detergent is stored, and a first detergent discharge port where the first fastening pipe is inserted when the first storage body is inserted into the first mounting groove along the width direction of the cover, and the second detergent box may include a second storage body where the detergent is stored, and a second detergent discharge port where the second fastening pipe is inserted when the second storage body is inserted into the second mounting groove along the width direction of the cover.

The first storage body may be restricted from moving in a height direction of the cover and a front and rear direction of the cover when the first fastening pipe is inserted into the first detergent discharge port, and the second storage body may be restricted from moving in the height direction of the cover and the front and rear direction of the cover when the second fastening pipe is inserted into the second detergent discharge port.

The laundry treating apparatus may further include a first withdrawal prevention portion preventing the first fastening pipe from being withdrawn from the first detergent discharge port when the first fastening pipe is inserted into the first detergent discharge port, and a second withdrawal prevention portion preventing the second fastening pipe from being withdrawn from the second detergent discharge port when the second fastening pipe is inserted into the second detergent discharge port.

The first withdrawal prevention portion may restrict the first storage body from moving in a direction away from the hub along the width direction of the cover, and the second withdrawal prevention portion may restrict the second storage body from moving in the direction away from the hub along the width direction of the cover.

The first storage body may be constructed such that at least two surfaces thereof are exposed to the outside of a first mounting space, and the second storage body may be constructed such that at least two surfaces thereof are exposed to the outside of a second mounting space.

At least one of the surfaces exposed to the outside of the first mounting groove of the first storage body may be entirely or partially made of a transparent material.

At least one of the surfaces exposed to the outside of the second mounting groove of the second storage body may be entirely or partially made of a transparent material.

The laundry treating apparatus may further include a first detergent inlet defined in a surface of the first storage body located outside the first mounting groove to enable introduction of the detergent into the first storage body, and a second detergent inlet defined in a surface of the second storage body located outside the second mounting groove to enable introduction of the detergent into the second storage body.

The first detergent inlet may be defined in a top surface of the first storage body parallel to the cover, and the first detergent discharge port may be disposed on a surface of the first storage body facing the hub, and the second detergent inlet may be defined in a top surface of the second storage body parallel to the cover, and the second detergent discharge port may be disposed on a surface of the second storage body facing the hub.

The laundry treating apparatus may further include a transferrer that transfers the detergent introduced into the first fastening pipe and the second fastening pipe to the tub.

The laundry treating apparatus may further include a tub inlet defined in the tub to be located under the laundry inlet, a water supply passage including a passage body fixed to the cabinet, and a chamber that is disposed inside the passage body and guides water supplied from a water supply source to the tub inlet, and a transferrer that guides the detergent introduced into the first fastening pipe and the second fastening pipe to the chamber.

The laundry treating apparatus may further include a drawer extendable from the chamber, and a detergent passage that is defined in the drawer and guides the detergent supplied to the drawer into the chamber.

The laundry treating apparatus may further include a connection chamber protruding from one surface of the passage body in an insertion direction of the drawer or in a direction perpendicular to the insertion direction of the drawer, wherein the connection chamber is in communication with the chamber, and the transferrer may include a first transferrer that moves the detergent introduced into the first fastening pipe to the connection chamber, and a second transferrer that moves the detergent introduced into the second fastening pipe to the connection chamber.

The laundry treating apparatus may further include a distributer disposed inside the chamber and located on the drawer, wherein the distributer guides some of water introduced into the chamber to the detergent passage and guides the rest to the connection chamber.

Advantageous Effects

The present disclosure provides the laundry treating apparatus equipped with the detergent supply that is mounted in the state of being exposed to the outside of the cabinet.

In addition, the present disclosure provides the laundry treating apparatus equipped with the detergent supply that may not only store the great amount of detergent, but also minimize the risk of separation from the cabinet by the vibration.

In addition, the present disclosure may provide the laundry treating apparatus that may introduce the detergent into the detergent supply mounted on the cabinet.

In addition, the present disclosure may provide the laundry treating apparatus that may check the remaining amount of detergent without removing the detergent supply from the cabinet.

DETAILED DESCRIPTION

Hereinafter, a preferred embodiment of a laundry treating apparatus and a method for controlling the same will be described in detail with reference to the attached drawings.

Figure 1:
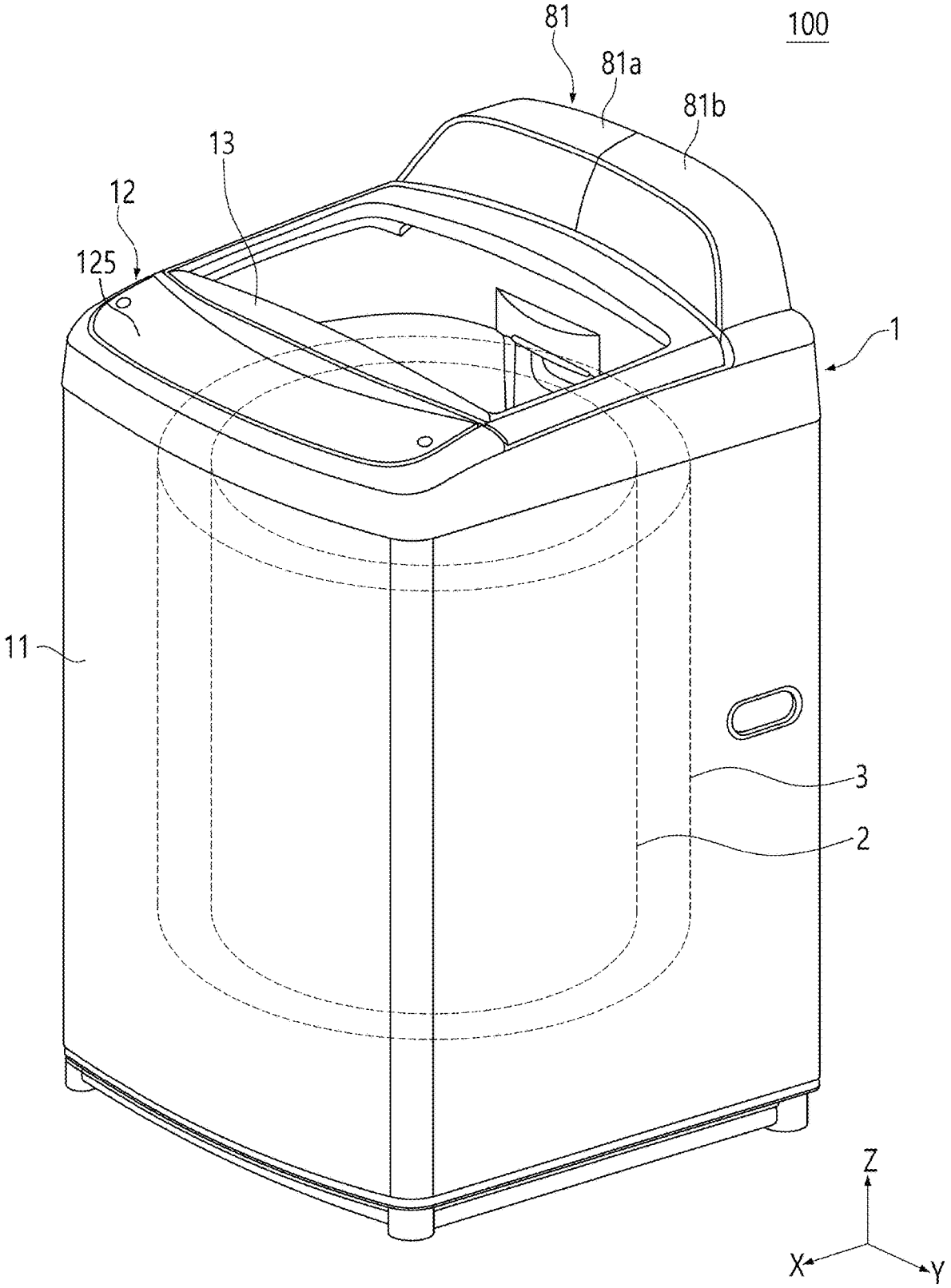
FIGS. 1 and 2 show an example of a laundry treating apparatus.

As shown in FIG. 1, a laundry treating apparatus 100 includes a cabinet 1, and treating portions 2 and 3 that are defined inside the cabinet to provide a space for receiving laundry.

Figure 2:
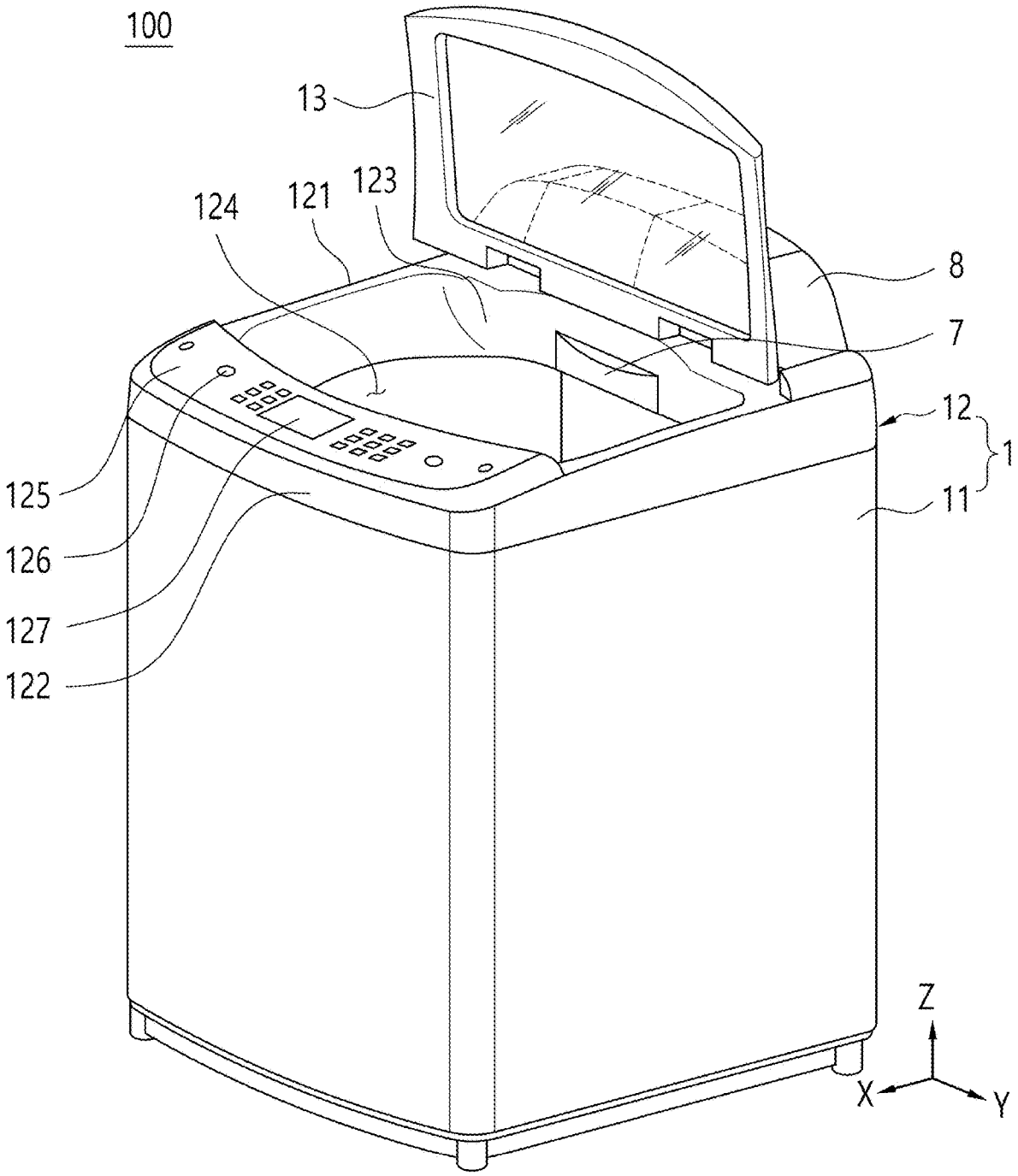

As shown in FIG. 2, the cabinet 1 may include a housing 11 that provides a space in which the treating portions are accommodated, and a cover 12 that closes an open top surface of the housing.

The cover 12 may include a cover body 121 fixed to the housing 11 to form a top surface of the laundry treating apparatus, and a laundry inlet 124 defined to extend through the cover body 121. The laundry inlet 124 may be closed by a door 13 pivotably coupled to the cover body 121.

The cover body 121 may include a front space (first space) 122 located in front of the laundry inlet 124, and a rear space (second space) 123 located at the rear of the laundry inlet 124. The front space 122 may have a control panel 125, and the control panel 125 may include an input device 126 that receives a control command from a user, and a display 127 that displays information related to the laundry treating apparatus.

Figure 3:
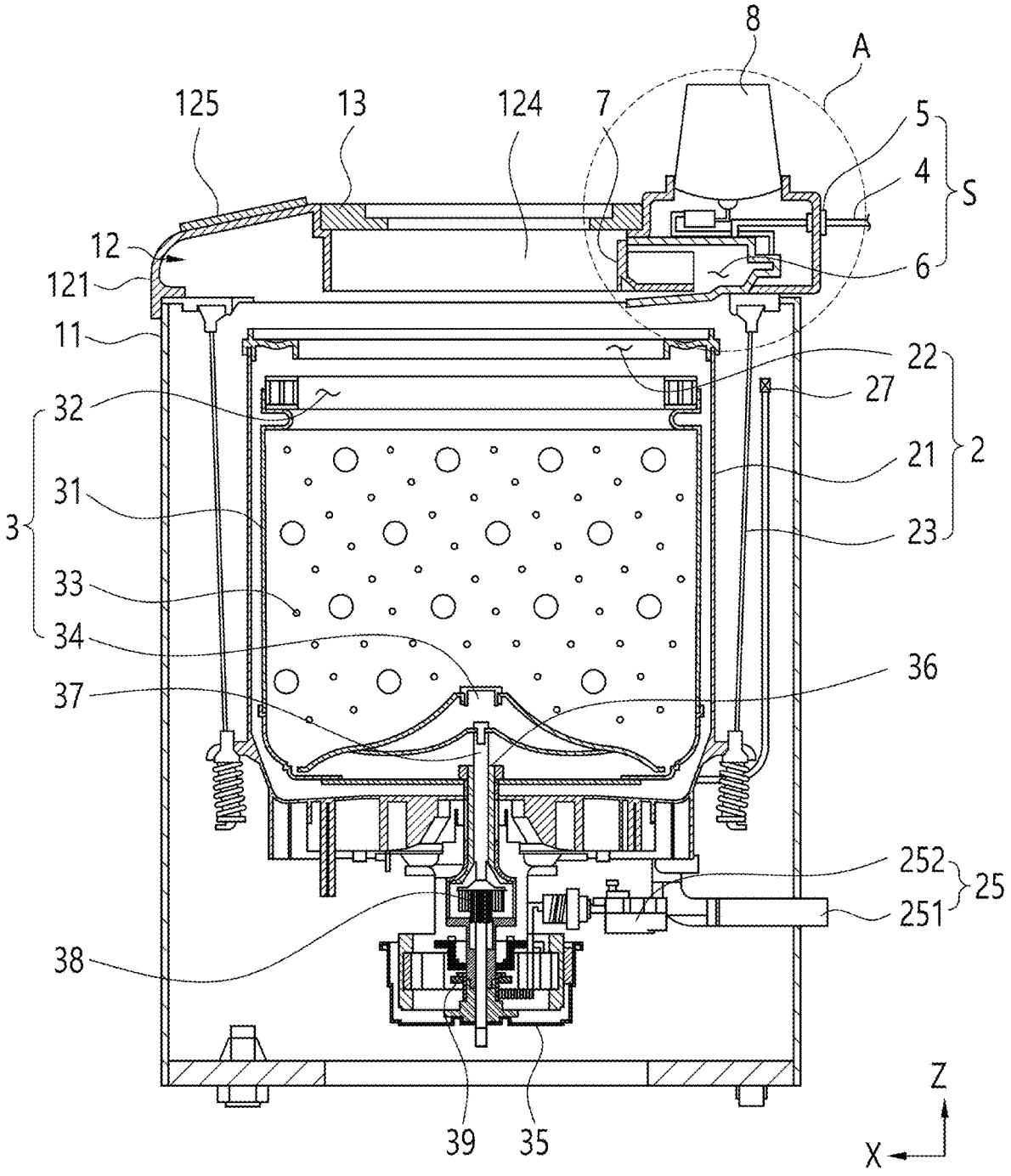
FIG. 3 shows an example of an internal structure of a laundry treating apparatus.

As shown in FIG. 3, the treating portion may include a tub 2 in which water is stored, and a drum 3 disposed inside the tub and storing an object-to-be-washed (the laundry and the like) supplied through the laundry inlet 124.

Because the tub 2 must be formed in a structure capable of storing water, the tub 2 may be formed as a cylindrical hollow tub body 21.

The tub body 21 is fixed to the cabinet 1 via a tub support 23. The tub support 23 may be formed as a bar having one end fixed to the cover 12 or the housing 11 and the other end fixed to a circumferential surface of the tub body 21. A top surface of the tub body 21 has a tub inlet 22 located under the laundry inlet 124.

The tub body 21 may receive water via a water supply S, and water inside the tub body 21 may be discharged to the outside of the cabinet 1 via a drainage 25.

The water supply S may include a water supply pipe 4 connected to a water supply source, a water supply valve 5 that controls opening and closing of the water supply pipe 4 in response to a control signal of a controller (a first controller), and a water supply passage 6 that guides water supplied from the water supply pipe 4 into the tub 2. FIG. 3 shows a case in which the water supply passage 6 guides water into the tub body 21 via the tub inlet 22.

The drainage 25 may include a drain pipe 251 that guides water inside the tub body 21 to the outside of the cabinet 1, and a drain valve 252 that controls opening and closing of the drain pipe in response to the control signal of the first controller.

The drum 3, as a means that is located inside the tub body 21 and provides a space for storing the laundry, may be formed as a cylindrical hollow drum body 31.

A top surface of the drum body 31 may have a drum inlet 32 located under the tub inlet 22. Accordingly, the user may put the laundry into the drum body 31 via the laundry inlet 124, the tub inlet 22, and the drum inlet 32. A communication hole 33 that allows the tub body 21 to be in communication with the inner space of the drum body 31 may be defined in a circumferential surface, a bottom surface, and the like of the drum body 31.

An agitator 34 that is disposed to be rotatable inside the drum body and is able to form a water flow inside the drum body 31 may be further disposed on the bottom surface of the drum body 31.

The drum body 31 and the agitator 34 are rotatable by a driver. The driver may include a motor 35 fixed to a bottom surface of the tub body 21 and located outside the tub body 21, a drum shaft 36 that connects the motor with the drum body 31, and an agitator shaft 37 that connects the motor with the agitator 34.

The agitator shaft 37 may be disposed to extend through the drum shaft 36 and directly connect a rotor of the motor 35 with the agitator 34. In this case, a gear 38 that connects the agitator shaft 37 with the drum shaft 36, and a clutch 39 that controls connection between one end of the drum shaft 36 and the rotor may be disposed inside the drum shaft 36.

Figure 4:
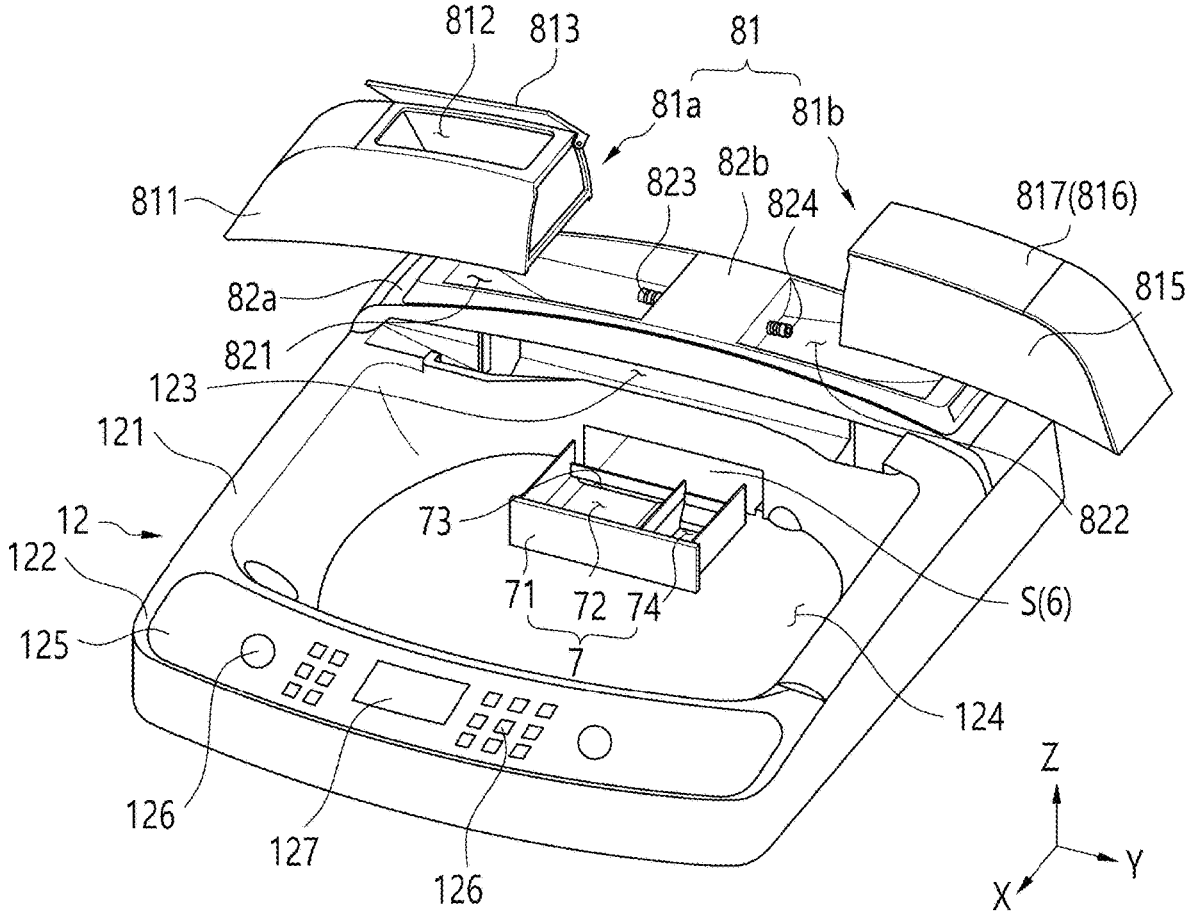
FIG. 4 shows an example of a detergent supply disposed in a laundry treating apparatus.

As shown in FIG. 4, the laundry treating apparatus 100 may have a detergent supply 7 and 8 for supplying detergent to the tub 2.

The detergent supply may include a first supply (a manual detergent supply) 7 that receives the detergent from the user and supplies the detergent to tub 2, and a second supply (an automatic detergent supply) 8 that supplies an appropriate amount of detergent to the tub 2 at a set time point under control of the first controller.

The first supply 7 may be formed as a drawer 71 that may be extended from the water supply passage 6 defined in the cover 12. The drawer 71 may be extended along a direction in which a center of the laundry inlet 124 is located (an +X-axis direction) from the water supply passage 6.

The drawer 71 may include a first detergent passage 72 and a second detergent passage 74 that guide the detergent provided from the user to the water supply passage 6.

The first detergent passage 72 and the second detergent passage 74 must define separate passages. The first detergent passage 72 may be connected to the water supply passage 6 via a first outlet 73, and the second detergent passage 74 may be connected to the water supply passage 6 via a second outlet.

The first outlet 73 may be defined as a hole that extends through a rear surface of the first detergent passage 72, and the second outlet may be defined as a siphon passage (or a water trap) that, when a certain amount or more of liquid (water or liquid detergent) is supplied to the second detergent passage 74, discharges the liquid to the water supply passage 6. In this case, the first detergent passage 72 will be able to be used as a supply passage of powder detergent or liquid detergent required for washing, and the second detergent passage 74 will be able to be used as a supply passage of liquid detergent or powder detergent introduced at a specific time (a rinsing cycle, a dehydration cycle, and the like).

As described above, the cover body 121 may include the front space 122 located in front of the laundry inlet 124, and the rear space 123 located at the rear of the laundry inlet 124. The second supply 8 may be located in the rear space 123. Unlike as shown in the drawing, the control panel 125 may be disposed in the rear space 123 and the second supply 8 may be disposed in the front space 122.

Figure 5:
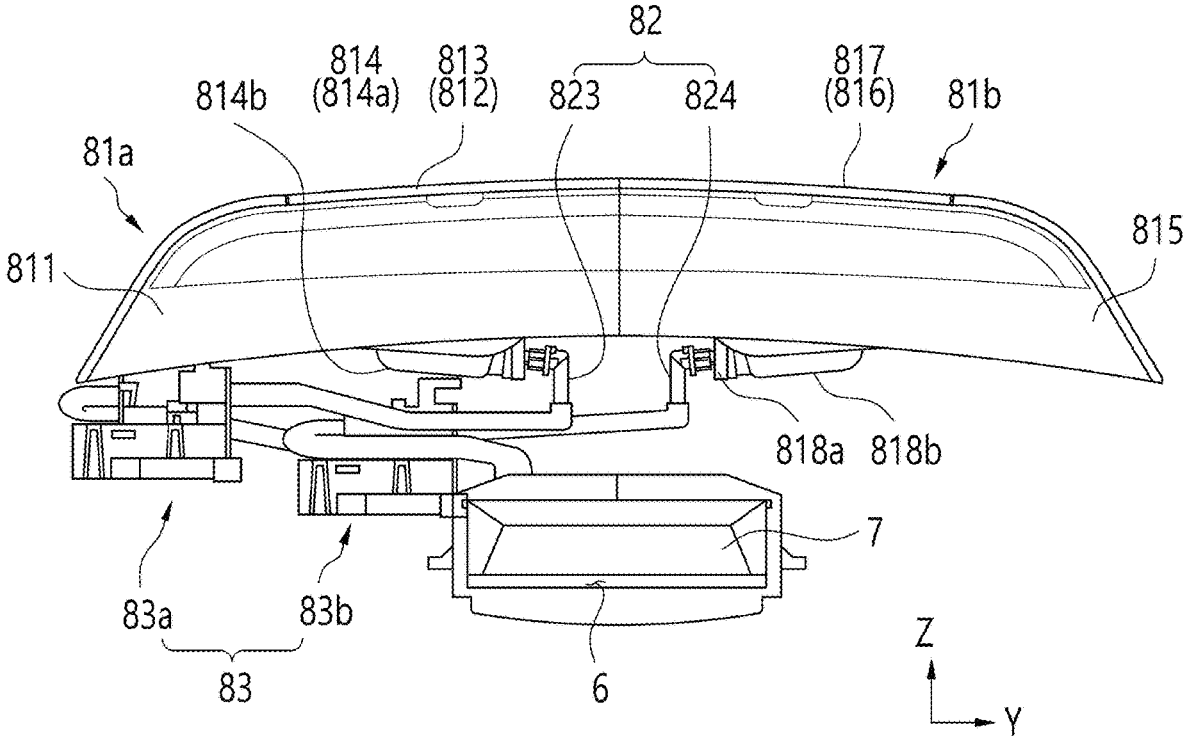
FIG. 5 shows an example of an automatic detergent supply (a second supply).

As shown in FIGS. 4 and 5, the second supply 8 may include a detergent box 81 that provides a space for storing the detergent, a mounting portion 82 fixed to the rear space 123 and to which the detergent box 81 is detachably fixed, and a transferrer 83 that withdraws the detergent from the detergent box 81 coupled to the mounting portion 82 and allows the detergent to flow to the water supply passage 6.

As shown in FIG. 5, the detergent box 81 may include a first detergent box 81*a* and a second detergent box 81*b* that are detachably fixed to the mounting portion 82.

The first detergent box 81*a* may include a storage body (a first storage body) 811 that provides a space for storing the detergent, a detergent inlet (a first detergent inlet) 812 defined to extend through one surface of the first storage body, and a detergent box door (a first detergent box door) 813 that may open and close the first detergent inlet.

Figure 6:
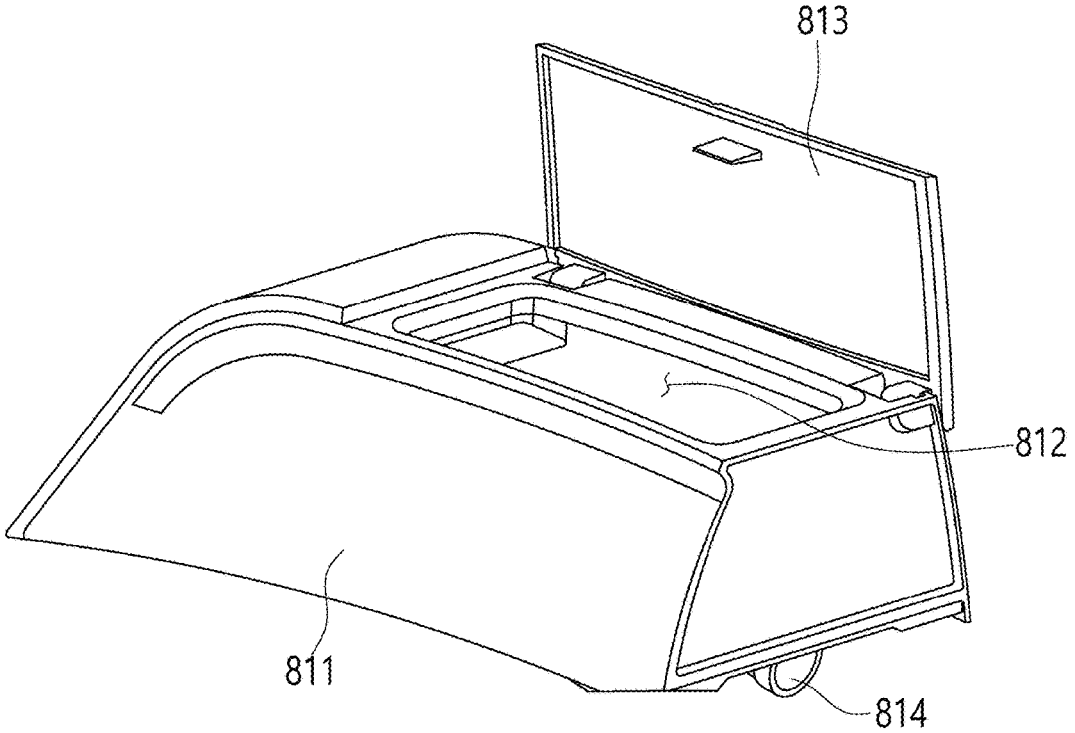
FIGS. 6 and 7 show an example of a first detergent box disposed in a second supply.

As shown in FIG. 6, the first detergent inlet 812 may be defined to extend through a top surface of the first storage body 811, and the first detergent box door 813 may be pivotably fixed to a top surface of the storage body 811.

Figure 7:
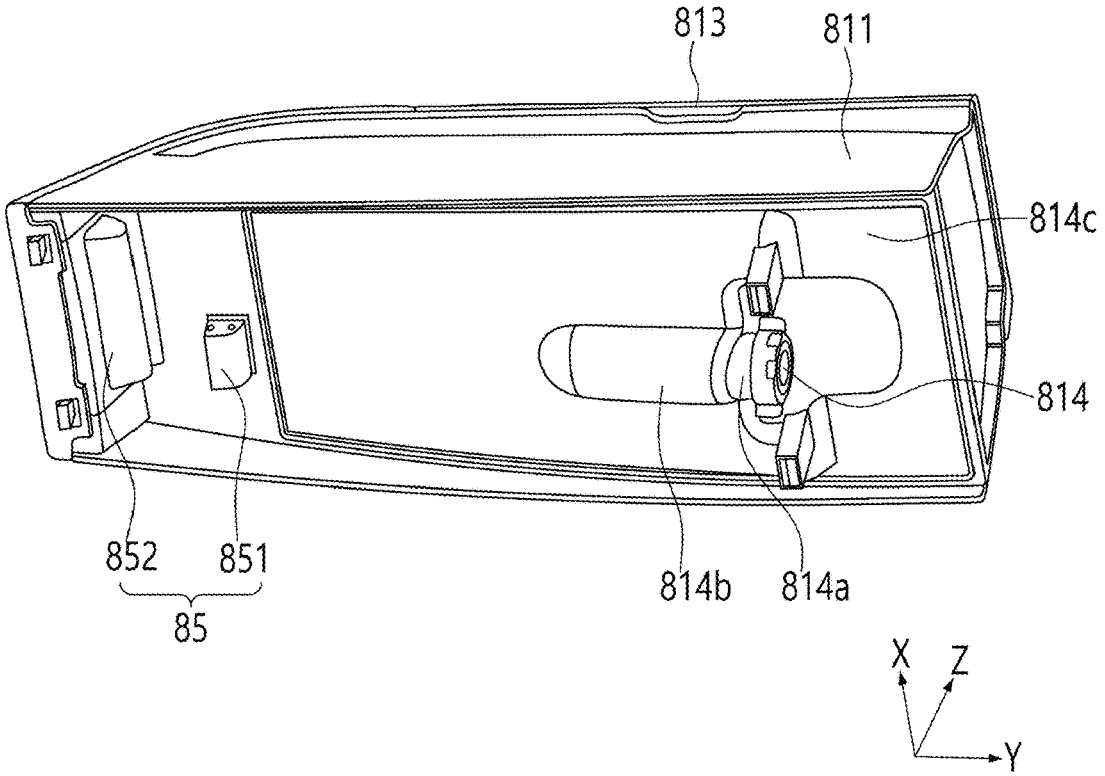

As shown in FIG. 7, a bottom surface of the first storage body 811 may have a detergent discharge port (a first detergent discharge port) 814, and the first detergent discharge port 814 may have a check valve (a first check valve) 814*a*.

A bottom surface 814*c* of the first storage body 811 may have a guide passage (a first guide passage) 814*b* that guides the detergent inside the first storage body 811 to the first detergent discharge port 814. In this case, the first detergent discharge port 814 may be located on a surface facing a direction in which a second storage body 815 is located (a surface facing a +Z-axis direction, a surface facing a hub of the mounting portion) in a space provided by the first guide passage 814*b*.

Figure 8:
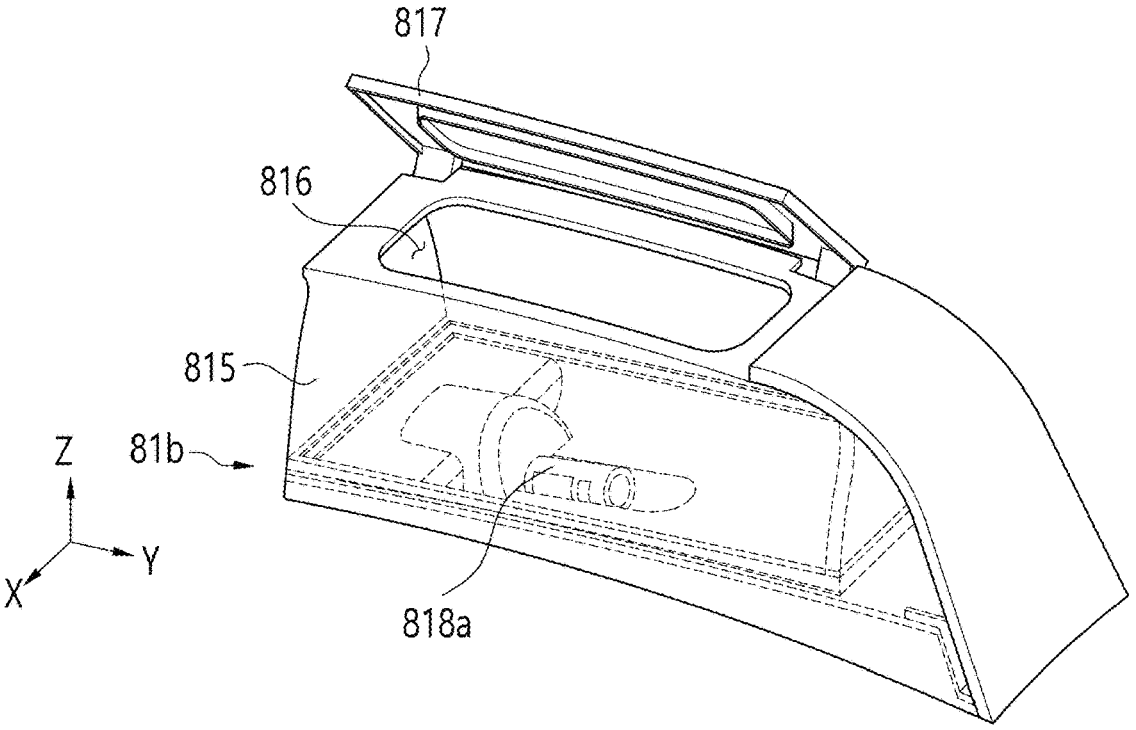
FIGS. 8 and 9 show an example of a second detergent box disposed in a second supply.

As shown in FIG. 8, the second detergent box 81*b* may include the storage body (the second storage body) 815 that provides a space for storing the detergent, a detergent inlet (a second detergent inlet) 816 defined to extend through one surface of the second storage body, and a detergent box door (a second detergent box door) 817 that may open and close the second detergent inlet.

The second detergent inlet 816 may be defined to extend through a top surface of the second storage body 815, and the second detergent box door 817 may be pivotably fixed to the top surface of the second storage body 815.

Figure 9:
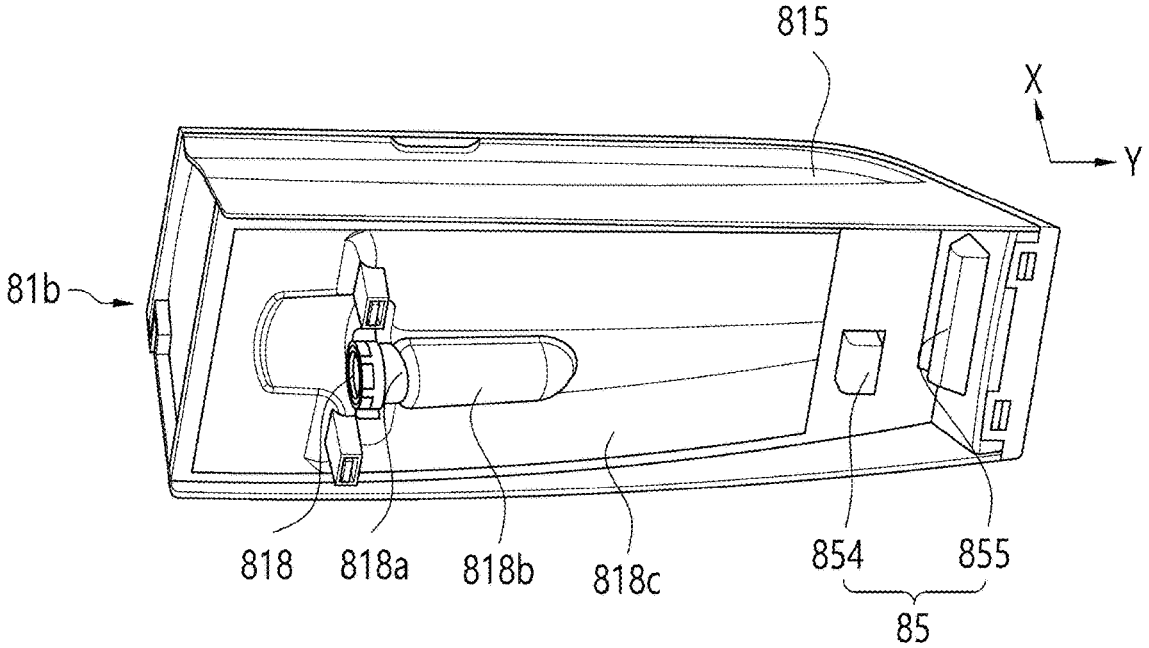
Figure 9:
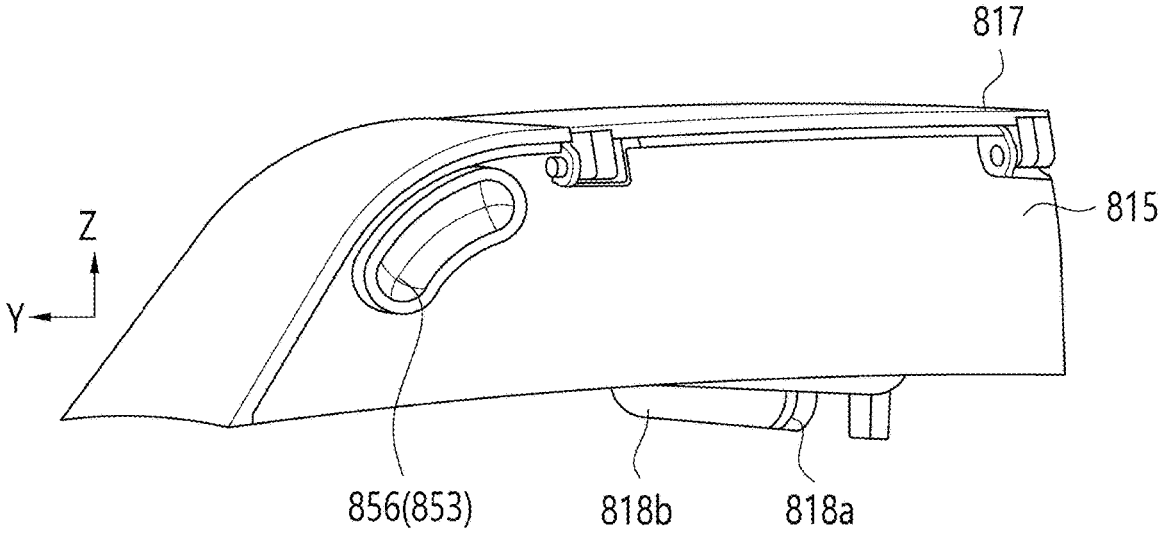

As shown in FIG. 9, a bottom surface 818*c* of the second storage body 815 may include a detergent discharge port (a second detergent discharge port) 818, and the second detergent discharge port 818 may have a check valve (a second check valve) 818*a*.

A bottom surface of the second storage body 815 may have a guide passage (a second guide passage) 818*b* that guides the detergent inside the second storage body 815 to the second detergent discharge port 818. In this case, the second detergent discharge port 818 may have a surface facing a direction in which the first storage body 811 is located (a surface facing a −Z-axis direction, a surface facing the hub of the mounting portion) in a space provided by the second guide passage 818*b*.

Figure 10:
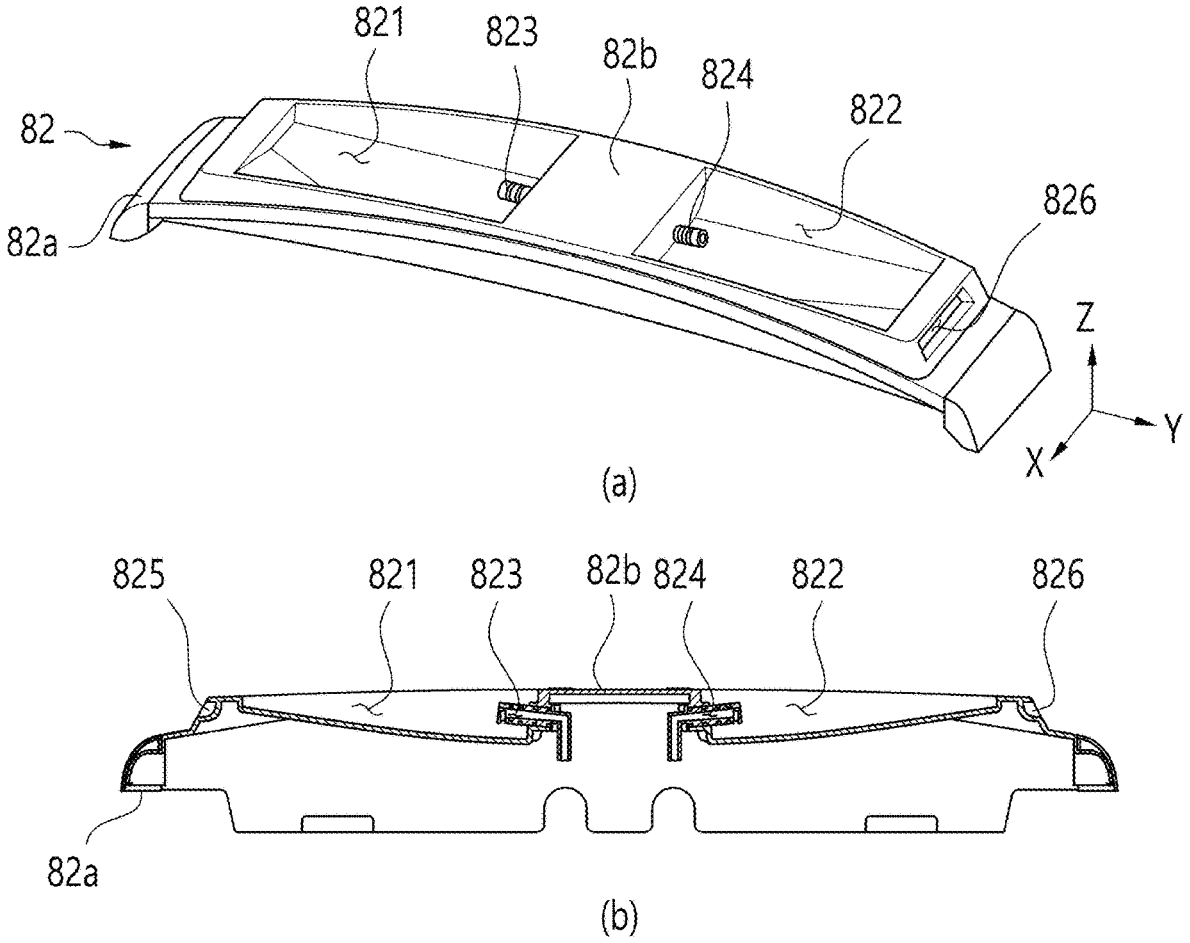
FIG. 10 shows an example of a mounting portion.

As shown in FIG. 10, the mounting portion 82 may include a mounting body 82*a* that is fixed to the cover body 121 and is located in the rear space 123 of the cover, and a hub 82*b* that is disposed on the mounting body 82*a* and to which the first detergent box 81*a* and the second detergent box 81*b* are fixed. FIG. 10 shows a case in which the hub 82*b* is positioned between the first detergent discharge port 814 and the second detergent discharge port 818 to fix the discharge ports 814 and 818 as an example.

The mounting body 82*a* has a first mounting space 821 and a second mounting space 822 arranged to face each other with the hub 82*b* interposed therebetween. The first mounting space 821 is a space where the first detergent box 81*a* is mounted, and the second mounting space 822 is a space where the second detergent box 81*b* is mounted.

The first mounting space 821 may be defined in a direction (a −Y-axis direction) away from the second mounting space 822 along a width direction of the cover body 121 from the hub 82*b*, and the second mounting space 822 may be defined in a direction (a +Y-axis direction) away from the first mounting space 821 along the width direction of the cover body 121 from the hub 82*b*.

The first mounting space 821 may be defined as a groove (a first mounting groove) in which the bottom surface of the first storage body 811 is accommodated, and the second mounting space 822 may be defined as a groove (a second mounting groove) in which the bottom surface of the second storage body 815 is accommodated.

For example, the first mounting space 821 may be defined as a groove that accommodates entire edges of the bottom surface of the first storage body 811, and the second mounting space 822 may be defined as a groove that accommodates entire edges of the bottom surface of the second storage body 815.

Additionally, a bottom surface of the first mounting space 821 and a bottom surface of the second mounting space 822 may be formed in a shape inclined downward toward the hub 82*b*. In this case, the bottom surface 814*c* or 818*c* of each of the storage bodies 811 and 815 is preferably inclined to correspond to a shape of the mounting space corresponding thereto.

The mounting portion 82 may include a first fastening pipe 823 that protrudes from the hub 82*b* in a direction away from the hub 82*b* (the −Y-axis direction) along the width direction of the cover body 121, and a second fastening pipe 824 that protrudes in the direction away from the hub (the +Y-axis direction) along the width direction of the cover body 121.

Figure 11:
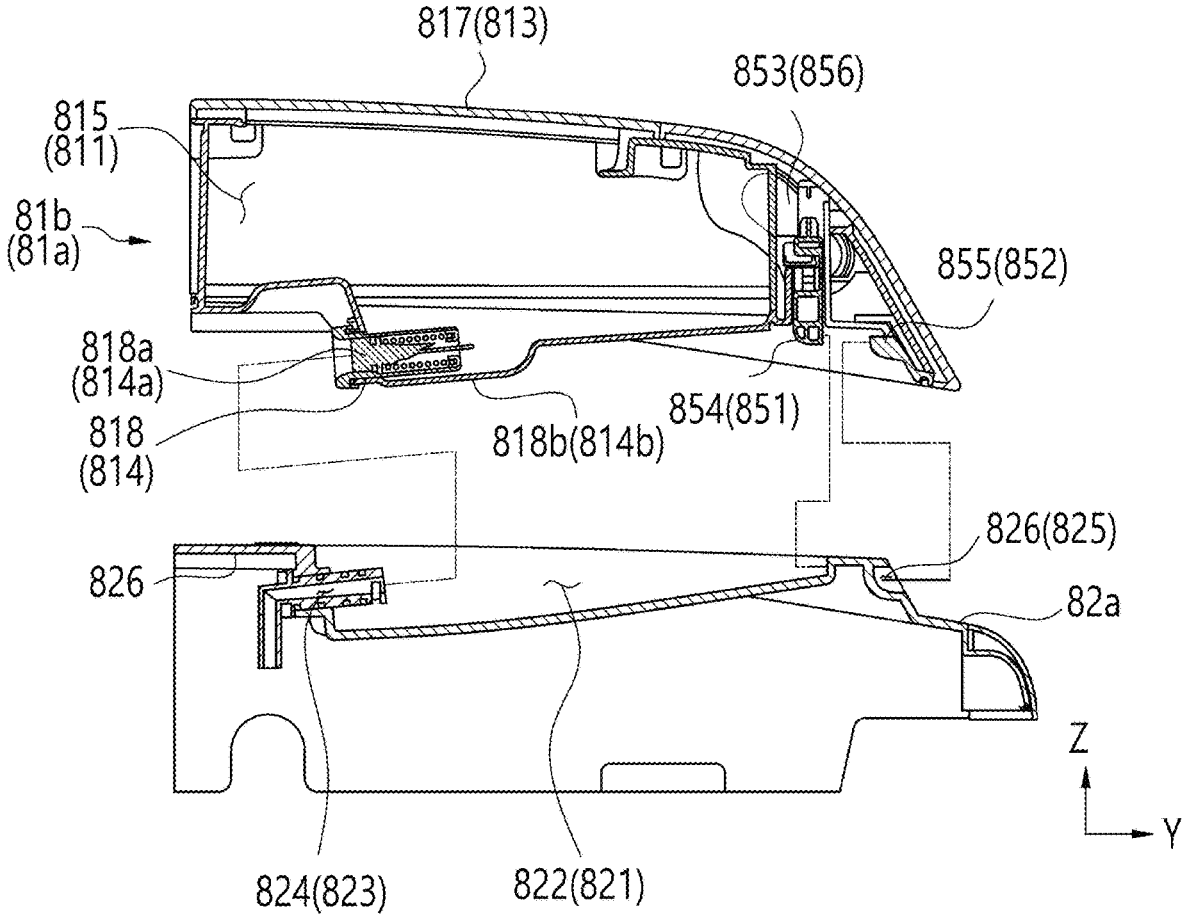
FIG. 11 shows a combined structure of a detergent box and a mounting portion.

As shown in FIG. 11, the first fastening pipe 823 may be inserted into the first detergent discharge port 814 of the first detergent box, and the second fastening pipe 824 may be inserted into the second detergent discharge port 818 of the second detergent box.

When the first detergent box 81*a* is inserted into the first mounting space 821, the first fastening pipe 823 is inserted into the first detergent discharge port 814, so that the first check valve 814*a* will open the first detergent discharge port 814. When the second detergent box 81*b* is inserted into the second mounting space 822, the second fastening pipe 824 is inserted into the second detergent discharge port 818, so that the second check valve 818*a* will open the second detergent discharge port 818.

Figure 12:
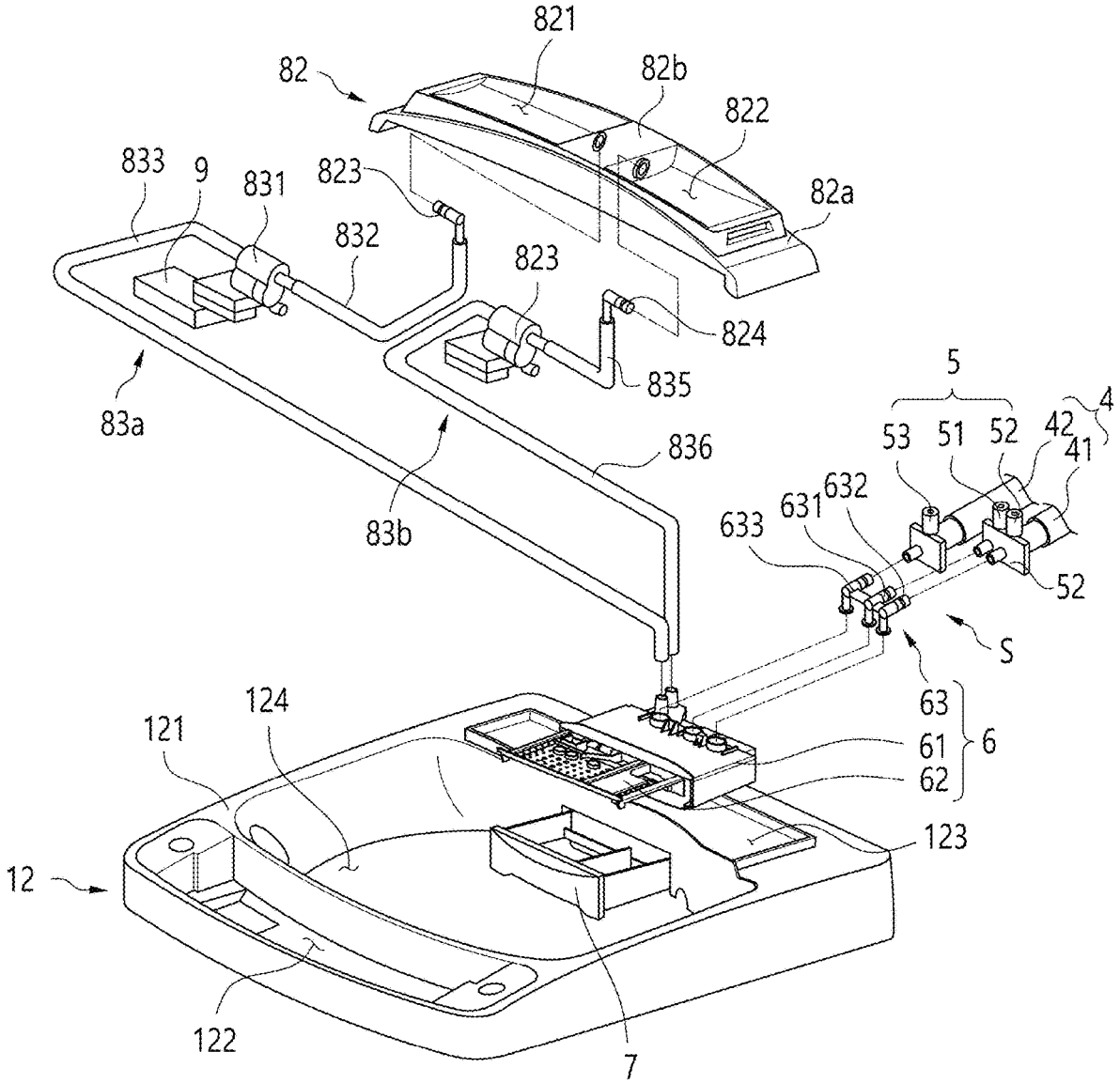
FIG. 12 shows an example of a transferrer.

As shown in FIG. 12, the transferrer 83 may include a first transferrer 83*a* that allows the detergent flowing into the first fastening pipe 823 to flow to the tub body 21, and a second transferrer 83*b* that allows the detergent flowing into the second fastening pipe 824 to flow to the tub body 21.

The first transferrer 83*a* may include a first detergent pump 831 mounted in the rear space 123 of the cover body, a first supply passage 832 that connects an inlet of the first detergent pump with the first fastening pipe 823, and a first discharge passage 833 that connects an outlet of the first detergent pump with the water supply passage 6.

The second transferrer 83*b* may include a second detergent pump 834 mounted in the rear space 123, a second supply passage 835 that connects an inlet of the second detergent pump with the second fastening pipe 824, and a second discharge passage 836 that connects an outlet of the second detergent pump with the water supply passage 6.

Because an open top surface of the rear space 123 is closed by the mounting body 82*a*, the first transferrer 83*a* and the second transferrer 83*b* mounted in the rear space 123 are not exposed to the outside of the cover by the mounting body 82*a*.

In addition, the transferrers 83*a* and 83*b* are disposed so as not to interfere with the spaces where the detergent boxes 81*a* and 81*b* are mounted. That is, the first transferrer 83*a* and the second transferrer 83*b* are disposed in the rear space 123 independent of the mounting spaces 821 and 822 rather than at the rear of the two detergent boxes 81*a* and 81*b*, so that the laundry treating apparatus 100 is advantageous in designing the storage bodies 811 and 815 disposed in the respective detergent boxes to have a great volume.

The first controller mentioned above is means for controlling at least one of the input device 126, the display 127, the motor 35, the water supply valve 5, and the drain valve 252. The first detergent pump 831 and the second detergent pump 834 that are disposed in the transferrer 83 may operate in response to the control signal of the first controller. However, as shown in FIG. 12, the first detergent pump 831 and the second detergent pump 834 may operate in response to a control signal of a second controller (a pump controller) 9 separate from the first controller.

When the second controller 9 is separated from the first controller, the first controller and the second controller 9 must be connected to each other to enable communication therebetween, and the second controller 9 is desirable to control the two detergent pumps based on a control command (an operating time point and an operating time duration of the pump) requested by the first controller. The second controller 9 is preferably fixed inside the rear space 123.

When the first controller and the second controller 9 are constructed as described above, the second supply 8 described above may be modularized (applicable to various laundry treating apparatuses with different structures) and a load of the first controller may be reduced, so that a possibility of operational errors in the laundry treating apparatus may be minimized.

As mentioned above, the water supply S may include the water supply pipe 4, the water supply valve 5, and the water supply passage 6.

The water supply pipe 4 may include a first water supply pipe 41 connected to a water supply source that supplies water at a first temperature, and a second water supply pipe 42 connected to a water supply source that supplies water at a second temperature higher than the first temperature.

The first water supply pipe 41 may be branched into a first branch pipe and a second branch pipe via a branch unit 54. In this case, the water supply valve 5 may be composed of a first valve 51 that controls opening and closing of the first branch pipe, a second valve 52 that controls opening and closing of the second branch pipe, and a third valve 53 that controls opening and closing of the second water supply pipe 42.

Figure 13:
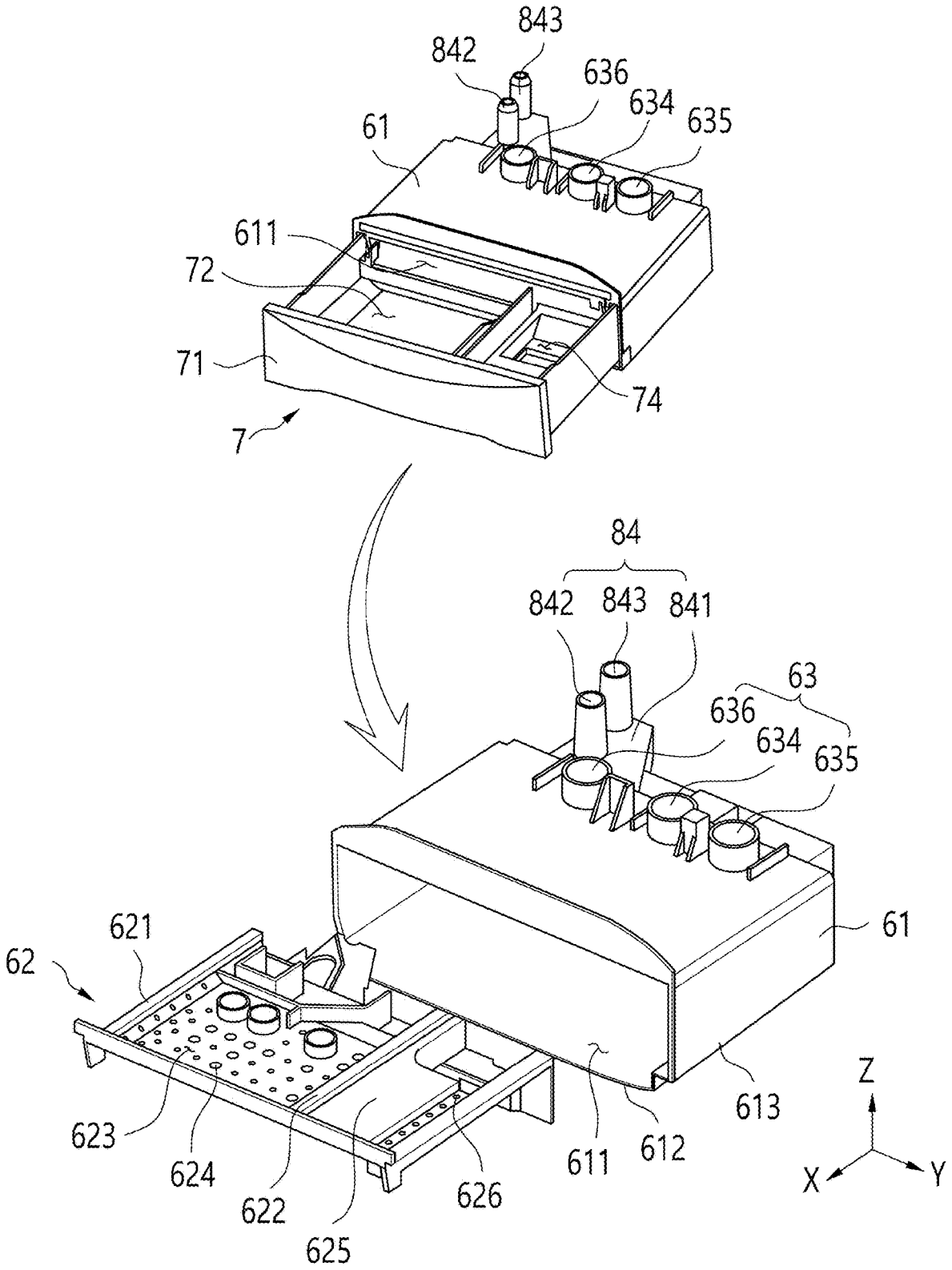
FIGS. 13, 14, and 15 show an example of a water supply passage and a manual detergent supply (a first supply).

As shown in FIG. 13, the water supply passage 6 may include a passage body 61 that is fixed to the cabinet 1 via the cover body 121, and a chamber 611 that is disposed in the passage body 61 and guides water supplied from the water supply pipe 4 to the tub inlet 22. One surface (a surface facing the center of the laundry inlet or the like) of the passage body 61 has a chamber outlet 612 that discharges liquid flowed into the chamber 611 to the tub inlet 22.

The chamber 611 is connected to the water supply valve 5 via an inlet 63. The inlet 63 may include a first inlet port 634, a second inlet port 635, and a third inlet port 636 that are disposed on the passage body 61 and connected to an upper space of the chamber 611.

As shown in FIG. 12, the first inlet port 634 may be connected to the first valve 51 via a first valve connecting pipe 631, the second inlet port 635 may be connected to the second valve 52 via a second valve connecting pipe 632, and the third inlet port 636 may be connected to the third valve 53 via a third valve connecting pipe 633.

As shown in FIG. 13, the drawer 71 of the first supply may be extended from the chamber 611 via the chamber outlet 612. In this case, the first outlet 73 and the second outlet of the drawer must discharge the detergent into the chamber 611.

Furthermore, a passage through which the detergent or water may flow must be defined between a bottom surface 613 of the chamber 611 and a bottom surface of the drawer 71 such that the detergent discharged from the drawer 71 into the chamber 611 may flow to the tub 2. FIG. 13 shows a case in which the chamber bottom surface 613 is formed as an inclined surface downwardly inclined toward the chamber outlet 612 to define the passage as an example.

The passage body 61 may further include a connection portion 84 that guides the detergent supplied from the transferrer 83 to the bottom surface 613 of the chamber.

The connection portion 84 may include a connection chamber 841 that protrudes from the passage body 61 and is in communication with the chamber 611, a first detergent supply pipe 842 that connects the first discharge passage 833 of the transferrer to the connection chamber 841, and a second detergent supply pipe 843 that connects the second discharge passage 836 of the transferrer to the connection chamber 841.

The connection chamber 841 may protrude in a direction in which the drawer 71 is inserted (the −X-axis direction) or in a width direction of the drawer (the Y-axis direction, a direction perpendicular to a direction in which the drawer is inserted).

When the detergent stored in the detergent box 81 is supplied via a top surface of the chamber 611 rather than the connection chamber 841, the detergent discharged from the transferrer 83 will be supplied to the tub 2 via the first detergent passage 72 or the second detergent passage 74 defined in the drawer 74 and the chamber bottom surface 613. Because the flow path of the detergent as described above is longer than a path in which the detergent flows to the tub 2 via the connection chamber 841 and the chamber bottom surface 613, a possibility that the detergent is not able to be entirely supplied to the tub and the detergent remains in the flow path increases. The connection chamber 841 is means of solving such problem.

Inside the chamber 611, a distributer 62 that is located on the drawer 71 and guides water flowing into the chamber 611 to the first detergent passage 72 and the second detergent passage 74 of the drawer may be further disposed. The distributer 62 may guide some of water flowing into the chamber 611 to the detergent passages 72 and 74 and guide the remainder to the connection chamber 841.

The distributer 62 may include a distribution body 621 fixed inside the chamber 611 and located on the drawer 71, and a partition wall 622 that divides the distribution body 621 into a first distribution space 623 located on the first detergent passage 72 of the drawer and a second distribution space 625 located on the second detergent passage 74.

Figure 14:
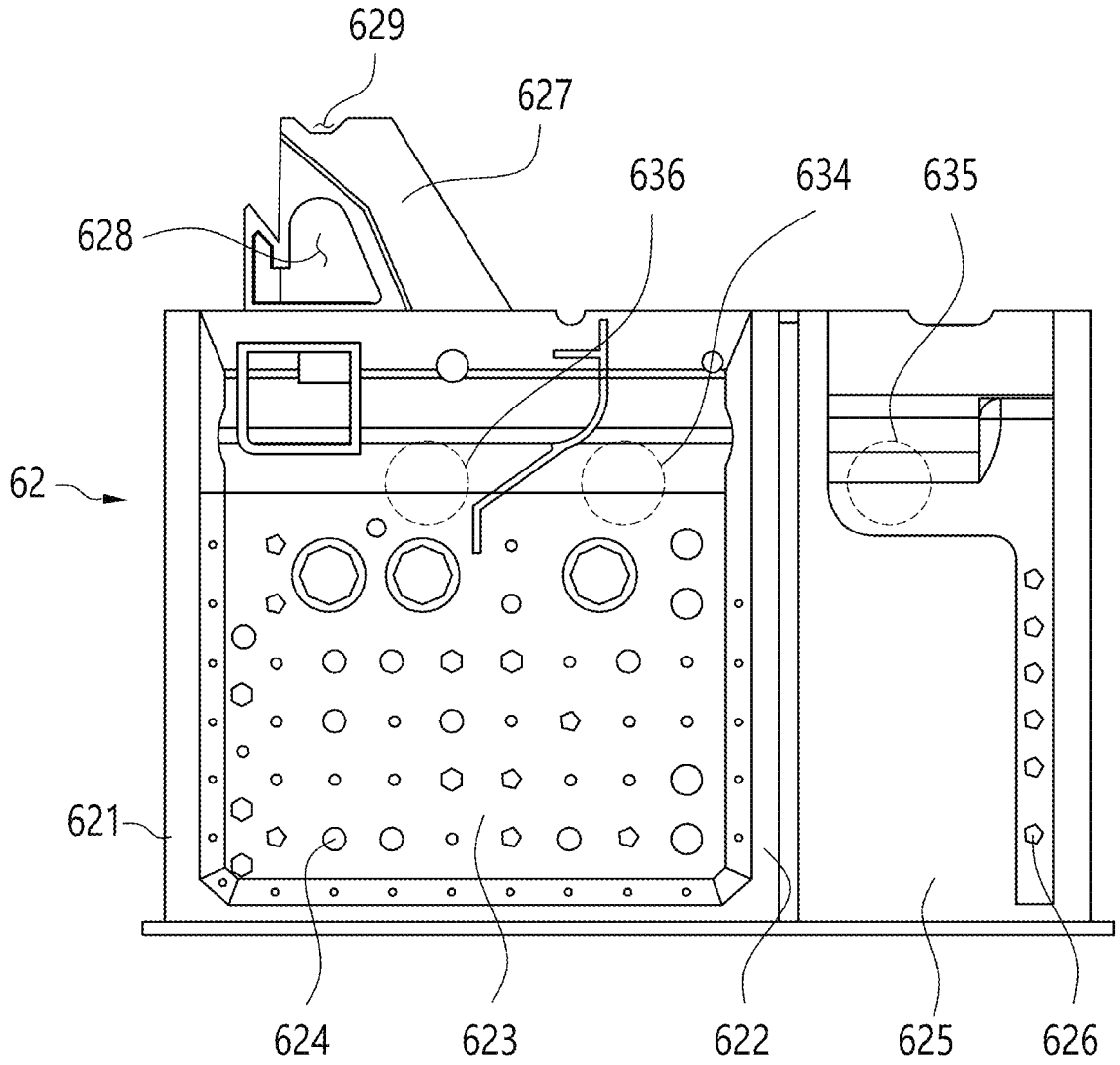

As shown in FIG. 14, the first distribution space 623 may have a first supply hole 624 extending through the first distribution space 623, and the second distribution space 625 may have a second supply hole 626 extending through the second distribution space 625.

Water discharged from the first water supply pipe 41 via the first valve 51 will be supplied to the first detergent passage 72 of the drawer via the first inlet port 634 and the first supply hole 624, and water discharged from the first water supply pipe 41 via the second valve 52 will be supplied to the second detergent passage 74 of the drawer via the second inlet port 635 and the second supply hole 626.

The distributer 62 may further include a guide 627 that facilitates flow of some of water supplied to the distribution body 621 toward the connection chamber 841.

The guide 627 may be formed as a board extending from a rear end of the distribution body 621 toward the connection chamber 841. In this case, the guide 627 may include a guide first through-hole 628 and a guide second through-hole 629.

The guide first through-hole 628 is means for allowing the detergent discharged from the first detergent supply pipe 842 to flow to a bottom surface of the connection chamber 841 without interfering with the guide, and the guide second through-hole 629 is means for allowing the detergent discharged from the second detergent supply pipe 843 to flow to the bottom surface of the connection chamber 841 without interfering with the guide. As shown in the drawing, the guide second through-hole 629 may be defined as a groove in which a free end of the guide 627 is concavely bent.

Figure 15:
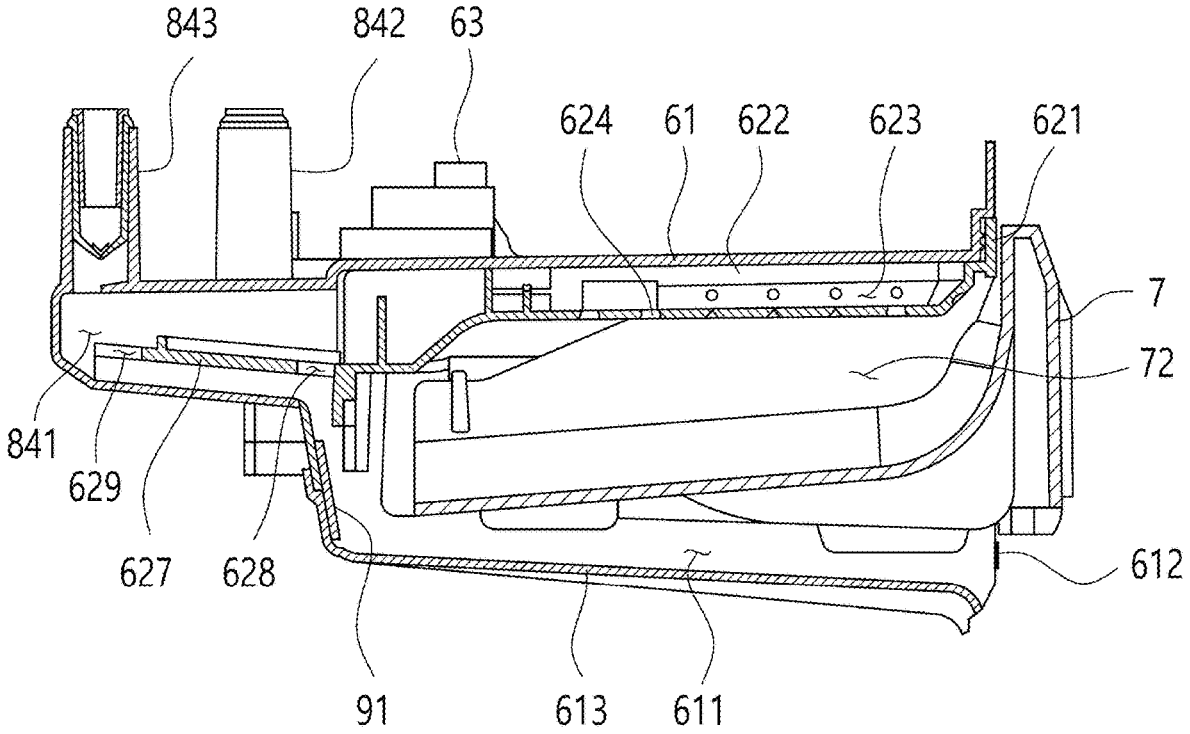

As shown in FIG. 15, the laundry treating apparatus equipped with the guide 627 is able to guide some of water flowing into the chamber 611 during water supply toward the connection chamber 841, so that a possibility that the detergent remains on the bottom surface of the connection chamber 841 may be minimized (a set amount of detergent may be entirely supplied to the tub).

Figure 16:
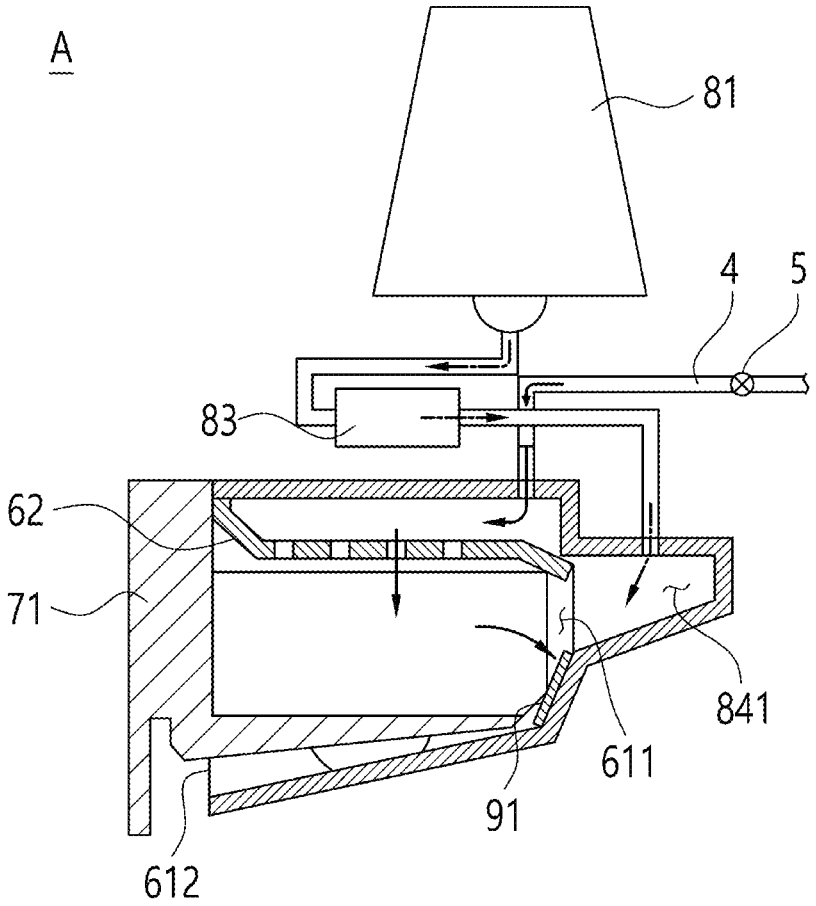
FIG. 16 shows a passage through which detergent is supplied to a tub.

As shown in FIG. 16, the laundry treating apparatus of the above-described structure supplies water to the drawer 71 via the water supply pipe 4 when the water supply valve 5 is operated, and the detergent inside the drawer 71 is supplied to the tub body 21 via the chamber outlet 612 after being discharged into the chamber 611 together with water.

In one example, the detergent stored in the detergent box 81 flows to the connection chamber 841 when the transferrer 83 is operated, and the detergent inside the connection chamber 841 is supplied to the tub body 21 via the chamber outlet 612.

As shown in FIG. 1, the laundry treating apparatus 100 described above has a structure in which the first detergent box 81*a* and the second detergent box 81*b* protrude from a top surface of the cover 12.

Considering that a top surface of the top-loading laundry treating apparatus 100 is generally located higher than a top surface of a front-loading laundry treating apparatus, a vibration amplitude of the first detergent box 81*a* and the second detergent box 81*b* described above may be greater than that of a detergent box (a detergent storage space) located at an upper portion of the front-loading washing machine when the laundry treating apparatus 100 operates.

That is, when the drum 3 rotates, great vibrations may occur in the first detergent box 81*a* and the second detergent box 81*b*, so that when the two detergent boxes are not firmly fixed to the cabinet 1 via the mounting portion 82, there is a possibility that the detergent boxes may be separated from the mounting portion 82 during the operation of the laundry treating apparatus 100.

To minimize the above-mentioned risk, the first detergent box 81*a* is formed such that, when the first storage body 811 is inserted into the first mounting space 821 along the width direction of the cover 12 (the +Y-axis direction), the first fastening pipe 823 is coupled to the first detergent discharge port 814.

When the first fastening pipe 823 is inserted into the first detergent discharge port 814, a movement of the first storage body 811 in a height direction of the cover 12 (the Z-axis direction) and a depth direction of the cover 12 (the X-axis direction, a front and rear direction of the cover) is restricted, so that the laundry treating apparatus 100 may suppress vibrations in the two directions of the first detergent box 81*a* only with the locations of the first fastening pipe 823 and the first detergent discharge port 814.

In addition, in the laundry treating apparatus 100, the first transferrer 83*a* that allows the detergent stored in the first detergent box 81*a* to flow to the tub is located in an external space of the mounting portion 82 (the rear space 123 of the cover), so that the volume of the first storage body 811 may be maximized.

The second detergent box 81*b* is formed such that, when the second storage body 815 is inserted into the second mounting space 822 along the width direction of the cover 12 (the −Y-axis direction), the second fastening pipe 824 is inserted into the second detergent discharge port 818.

When the second fastening pipe 824 is inserted into the second detergent discharge port 818, a movement of the second storage body 815 in the height direction of the cover 12 (the Z-axis direction) and the depth direction of the cover 12 (the front and rear direction of the cover, the X-axis direction) is restricted, so that the laundry treating apparatus may suppress vibrations in the two directions of the second detergent box 81*b* only with the locations of the second fastening pipe 824 and the second detergent discharge port 818.

In addition, in the laundry treating apparatus 100, the second transferrer 83*b* that allows the detergent stored in the second detergent box 81*b* to flow to the tub is located in the external space of the mounting portion 82 (the rear space 123 of the cover), so that the volume of the second storage body 815 may be maximized.

In one example, an edge of the first storage body 811 may be inserted into the first mounting space 821, and an edge of the second storage body 815 may be inserted into the second mounting space 822. Accordingly, the laundry treating apparatus 100 may also suppress the vibrations of each detergent box along the width direction (the Y-axis direction) and the depth direction (the X-axis direction) of the cover.

As shown in FIGS. 7 and 9, to more effectively suppress the vibrations of the detergent boxes 81*a* and 81*b*, the second supply 8 may further include a fixing portion 85. The fixing portion 85 may include a first withdrawal prevention portion 851 disposed on the first storage body 811 and a second withdrawal prevention portion 854 disposed on the second storage body 815.

As shown in FIG. 7, the first withdrawal prevention portion 851 may be formed to restrict the first detergent box 81*a* from moving along the width direction of the cover (the −Y-axis direction) when the first fastening pipe 823 is inserted into the first detergent discharge port 814.

The first withdrawal prevention portion 851 may be formed as a bar that may reciprocate along a height direction of the first detergent box 81*a* (the Z-axis direction). When the first detergent box 81*a* is seated in the first mounting space 821, a free end of the first withdrawal prevention portion 851 may be withdrawn from the first detergent box 81*a* to be in contact with an edge of the first mounting space 821. The first withdrawal prevention portion 851 may move into the first detergent box 81*a* by a first lever 853 disposed on the first storage body 811.

As shown in FIG. 9, the second withdrawal prevention portion 854 may be formed to restrict the second detergent box 81*b* from moving along the width direction of the cover (the +Y-axis direction) when the second fastening pipe 824 is inserted into the second detergent discharge port 818.

The second withdrawal prevention portion 854 may be formed as a bar that may reciprocate along a height direction of the second detergent box 81*b* (the Z-axis direction). When the second detergent box 81*b* is seated in the second mounting space 822, a free end of the second withdrawal prevention portion 854 may be withdrawn from the second detergent box 81*b* to be in contact with an edge of the second mounting space 822. The second withdrawal prevention portion 854 may move into the second detergent box 81*b* by a second lever 856 disposed on the second detergent box 81*b*.

The fixing portion 85 may further include a first body fixing portion 852 disposed in the first detergent box 81*a* and a second body fixing portion 855 disposed in the second detergent box 81*b*.

The first body fixing portion 852 may be formed as a protrusion protruding from the edge of the first detergent box 81*a* toward the first detergent discharge port 814, and the second body fixing portion 855 may be formed as a protrusion protruding from the edge of the second detergent box 81*b* toward the second detergent discharge port 818.

In this case, the mounting body 82*a* preferably has a first fixing groove 825 into which the first body fixing portion 852 is inserted, and a second fixing groove 826 into which the second body fixing portion 855 is inserted. When the first detergent box 81*a* is coupled to the first mounting space 821, the first body fixing portion 852 will be inserted into the first fixing groove 825 and the second body fixing portion 855 will be inserted into the second fixing groove 826.

The first body fixing portion 852 and the first fixing groove 825 restrict the first detergent box 81*a* from moving in the depth direction (the X-axis direction) and the height direction (the Z-axis direction) of the cover 12, and the direction in which the hub 82*b* is located (the +Y-axis direction). The second body fixing portion 855 and the second fixing groove 826 may restrict the second detergent box 81*b* from moving in the depth direction (the X-axis direction) and the height direction (the Z-axis direction) of the cover 12, and the direction in which the hub 82*b* is located (the −Y axis direction).

The first detergent box 81*a* and the second detergent box 81*b* are fixed to the mounting portion 82 such that at least two of multiple surfaces constituting the first storage body 811 are exposed to the outside of the first mounting space 821 and at least two of multiple surfaces constituting the second storage body 815 are exposed to the outside of the second mounting space 822. However, the first detergent box 81*a* and the second detergent box 81*b* may be stably fixed to the cabinet 1 via the fastening pipes 823 and 824, the detergent discharge ports 814 and 818, and the fixing portion 85 described above.

One surface of the first storage body 811 (a surface facing the direction in which the laundry inlet is located or the like) exposed to the outside of the first mounting space 821 may be entirely or partially made of a transparent material. This is to allow the user to check a remaining amount of detergent without separating the first detergent box from the mounting portion 82. For the same reason, one surface of the second storage body 815 (a surface facing the direction in which the laundry inlet is located or the like) exposed to the outside of the second mounting space 822 may be entirely or partially made of the transparent material.

The first detergent inlet 812 may be defined in the surface of the first storage body 811 located outside the first mounting space 821, and the second detergent inlet 816 may be defined in the surface of the second storage body 815 located outside the second mounting space 822. This is to enable the detergent to be injected into each detergent box without separating the first detergent box and the second detergent box from the mounting portion 82. FIG. 4 shows a case in which the first detergent inlet 812 is defined in the top surface of the first storage body 811 and the second detergent inlet 816 is defined in the top surface of the second storage body 815 as an example.

Because the structure and the control method of the laundry treating apparatus described above describe an example of the present disclosure, the scope of rights of the present disclosure is not able to be limited to the structure and the control method described above.

What is claimed is:

1. A laundry treating apparatus comprising:

a cabinet having a cover defining a top surface of the cabinet, the cover having a laundry inlet extending therethrough;

a tub located inside the cabinet, the tub being configured to store water therein;

a drum rotatably located inside the tub, the drum being configured to store laundry therein;

a mounting portion including:

a hub fixed to the cover;

a first mounting groove; and a second mounting groove facing the first mounting groove along a width direction of the cover with the hub interposed therebetween;

a first detergent box configured to store a detergent therein, the first detergent box being slidable toward the hub from an edge of the first mounting groove along the width direction of the cover; and a second detergent box configured to store the detergent therein, the second detergent box being slidable toward the hub from an edge of the second mounting groove along the width direction of the cover.

2. The laundry treating apparatus of claim 1, wherein the mounting further portion includes:

a first fastening pipe protruding from the hub along the width direction of the cover, the first fastening pipe being configured to place the tub in communication with the first detergent box; and a second fastening pipe protruding from the hub along the width direction of the cover, the second fastening pipe being configured to place the tub in communication with the second detergent box.

3. The laundry treating apparatus of claim 2, wherein the first detergent box includes:

a first storage body configured to store the detergent; and a first detergent discharge port configured to receive the first fastening pipe when the first storage body is inserted into the first mounting groove along the width direction of the cover, and wherein the second detergent box includes:

a second storage body configured to store the detergent; and a second detergent discharge port configured to receive the second fastening pipe therein when the second storage body is inserted into the second mounting groove along the width direction of the cover.

4. The laundry treating apparatus of claim 3, wherein the first storage body is restricted from moving in a height direction of the cover and a front and rear direction of the cover when the first fastening pipe is inserted into the first detergent discharge port, and wherein the second storage body is restricted from moving in the height direction of the cover and the front and rear direction of the cover when the second fastening pipe is inserted into the second detergent discharge port.

5. The laundry treating apparatus of claim 4, further comprising:

a first withdrawal prevention portion configured to prevent the first fastening pipe from being withdrawn from the first detergent discharge port when the first fastening pipe is received in the first detergent discharge port; and a second withdrawal prevention portion configured to prevent the second fastening pipe from being withdrawn from the second detergent discharge port when the second fastening pipe is received in the second detergent discharge port.

6. The laundry treating apparatus of claim 5, wherein the first withdrawal prevention portion is configured to restrict the first storage body from moving in a direction away from the hub along the width direction of the cover, and wherein the second withdrawal prevention portion is configured to restrict the second storage body from moving in a direction away from the hub along the width direction of the cover.

7. The laundry treating apparatus of claim 3, wherein at least two surfaces of the first storage body are exposed outside of the first mounting groove, and wherein at least two surfaces of the second storage body are exposed outside of the second mounting groove.

8. The laundry treating apparatus of claim 7, wherein at least one of the two surfaces of the first storage body exposed outside of the first mounting groove is a least partially made of a transparent material.

9. The laundry treating apparatus of claim 8, wherein at least one of the two surfaces of the second storage body exposed outside of the second mounting groove is at least partially made of a transparent material.

10. The laundry treating apparatus of claim 3, wherein the first storage body includes a first detergent inlet located in a surface outside of the first mounting groove, and wherein the second storage body includes a second detergent inlet located in a surface outside of the second mounting groove.

11. The laundry treating apparatus of claim 3, wherein the first storage body includes:

a first detergent inlet in a top surface of the first storage body parallel to the cover; and the first detergent discharge port located on a surface of the first storage body opposite the top surface, the first detergent discharge port facing the hub, and wherein the second storage bodying includes:

a second detergent inlet in a top surface of the second storage body parallel to the cover; and the second detergent discharge port located on a surface of the second storage body opposite the top surface, the second discharge port facing the hub.

12. The laundry treating apparatus of claim 3, further comprising a transferrer configured to transfer the detergent introduced into the first fastening pipe and the second fastening pipe to the tub.

13. The laundry treating apparatus of claim 3, further comprising:

a tub inlet in the tub, the tub inlet being located under the laundry inlet;

a water supply passage including:

a passage body fixed to the cabinet; and a chamber located inside the passage body and configured to guide water supplied from a water supply source to the tub inlet; and a transferrer configured to guide the detergent introduced into the first fastening pipe and the second fastening pipe to the chamber.

14. The laundry treating apparatus of claim 13, further comprising a drawer extendable from the chamber, the drawer including a detergent passage configured to guide the detergent introduced into the first fastening pipe and the second fastening pipe into the chamber.

15. The laundry treating apparatus of claim 14, wherein the passage body includes a connection chamber protruding from one surface of the passage body in an insertion direction of the drawer or in a direction perpendicular to the insertion direction of the drawer, the connection chamber being in communication with the chamber, and wherein the transferrer includes:

a first transferrer configured to move the detergent introduced into the first fastening pipe to the connection chamber; and a second transferrer configured to move the detergent introduced into the second fastening pipe to the connection chamber.

16. The laundry treating apparatus of claim 15, further comprising a distributer located inside the chamber and above the drawer, the distributer being configured to guide some of the water introduced into the chamber to the detergent passage and to guide a remainder of the water introduced into the chamber to the connection chamber.

17. The laundry treating apparatus of claim 3, wherein the first detergent box further includes a first check valve at a distal end of the first detergent discharge port, and wherein the second detergent box includes a second check valve at a distal end of the second detergent discharge port.

18. The laundry treating apparatus of claim 1, wherein at least two surfaces of the first detergent box are exposed outside of the first mounting groove, and wherein at least two surfaces of the second detergent box are exposed outside of the second mounting groove.

19. The laundry treating apparatus of claim 18, wherein at least one of the two surfaces of the first detergent box exposed outside of the first mounting groove is a least partially made of a transparent material.

20. The laundry treating apparatus of claim 19, wherein at least one of the two surfaces of the second detergent box exposed outside of the second mounting groove is at least partially made of a transparent material.

* * * * *